United States Patent [19]

Mellsjö

[11] Patent Number: 4,844,153

[45] Date of Patent: Jul. 4, 1989

[54] HEAT EXCHANGER

[76] Inventor: Carl G. Mellsjö, Helsingevägen 7, S-186 00 Vallentuna, Sweden

[21] Appl. No.: 64,242

[22] Filed: Jun. 19, 1987

Related U.S. Application Data

[62] Division of Ser. No. 777,776, Sep. 13, 1985, Pat. No. 4,697,636.

[30] Foreign Application Priority Data

Feb. 3, 1984 [SE] Sweden ..... 8400566

[51] Int. Cl.[4] ..... F28F 1/06; F28F 13/08

[52] U.S. Cl. ..... 165/174; 138/38; 165/177; 165/179

[58] Field of Search ..... 165/174, 156, 177, 179; 138/38

[56] References Cited

U.S. PATENT DOCUMENTS 1,246,583 11/1917 Fulweiler ..... 138/38

2,115,769 5/1938 Harris ..... 165/177

4,132,264 1/1979 Furlong ..... 138/38

FOREIGN PATENT DOCUMENTS 2420002 11/1975 Fed. Rep. of Germany ..... 138/38

*Primary Examiner*—Albert W. Davis, Jr.

*Attorney, Agent, or Firm*—Shapiro and Shapiro

[57] ABSTRACT

A helical flow heat exchanger comprises a hollow casing with an outwardly protruding helical trough which defines a helical flow path along the internal periphery of the casing. The casing has an inlet at one end for introducing fluid tangentially into the casing and an outlet at another end from which the fluid exits the casing. A blocking body is disposed within the casing to substantially block fluid flow along the length of the casing inward from the peripheral helical flow path and to force fluid that has deviated inwardly back out into the flow path to maintain helical flow.

8 Claims, 2 Drawing Sheets

HEAT EXCHANGER

This application is a division of application Ser. No. 777,776 filed Sept. 13, 1985.

The present invention relates to a heat exchanger for exchange of heat between two media, especially gas and liquid, in heat pumps and the like, including an elongated, generally cylindrical space passed through by one medium and having an inlet arranged at one end and an outlet at the other end, and a helical wall radially defining said space and delimiting a space through which the other medium is intended to flow.

There are known heat exchangers consisting of a generally cylindrical casing the ends of which are provided with respectively an inlet and outlet for one medium, preferably the gas, and a helical pipe coil arranged within the space in said casing and through which the other medium, preferably the liquid, is allowed to flow. In a manner per se known the media are suitably allowed to flow in opposite directions. The hot medium, which enters at one end of the casing, may to begin with have a rotary movement so that it will sweep along the pipe coil; but this movement decreases rapidly and the gas flows substantially linearly through the casing, i.e. through the space within the pipe spiral, with the result that the heat exchange in that portion of the casing which is remote from the inlet will be deficient.

The object of this invention is to provide a substantially improved efficiency by a modification of heat exchangers of the above-mentioned type.

The essential characteristic of the apparatus according to the invention is that the inlet into the cylindrical space is tangentially arranged, whereby the tangent line through the inlet is generally parallel with a tangent drawn from the helical line of the wall, that between the two ends of the cylindrical space there are arranged a number of bodies securing the intended circulatory movement, substantially blocking the central portion of the space in the axial direction and adapted to utilize the interspace between the coil turns as guide elements maintaining the media circulation, by guiding outwardly towards the wall the medium flowing through said space.

Examples of embodiments of heat exchangers according to the invention will be described more fully below with reference to the accompanying drawing in which.

Figure 1:
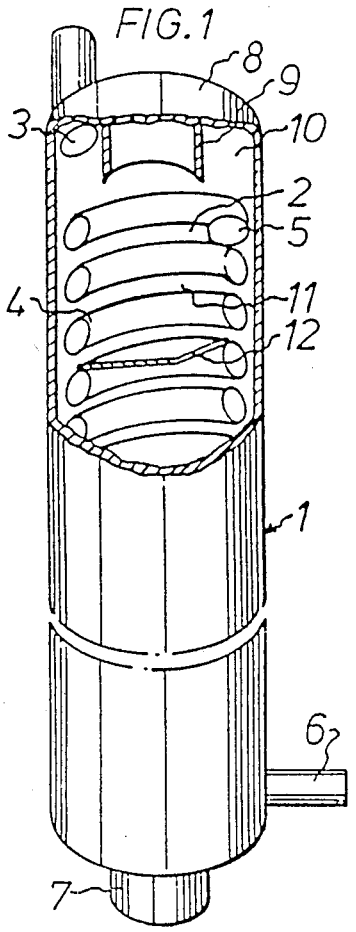
FIG. 1 is a cross-section through a heat exchanger according to the invention.

In the drawing, 1 designates a generally cylindrical casing constituting the space or compartment through which one medium, i.e. the gas, passes. Arranged at one end of the casing is a tangential inlet 3 through which the warm gas from a hot gas source, e.g. a compressor in a heat pump, flows into the space 2 in the casing. Arranged within the casing 1 in the space 2 is a helically wound pipe coil 4 and this has an inlet 5 and an outlet 6. The outlet 7 of the casing 1 may be axial but it may of course also be tangentially arranged.

A rotary movement is imparted to the inflowing medium by means of the tangential inlet 3, and to secure this movement during an initial stage a coaxially disposed guide surface 9 is arranged at the end wall 8 of the casing. After having left the inlet opening the medium will thereby be guided by a slot 10 situated between the guide surface 9 and the casing wall 1 and advance along the wall of the space 2.

Figure 1A:
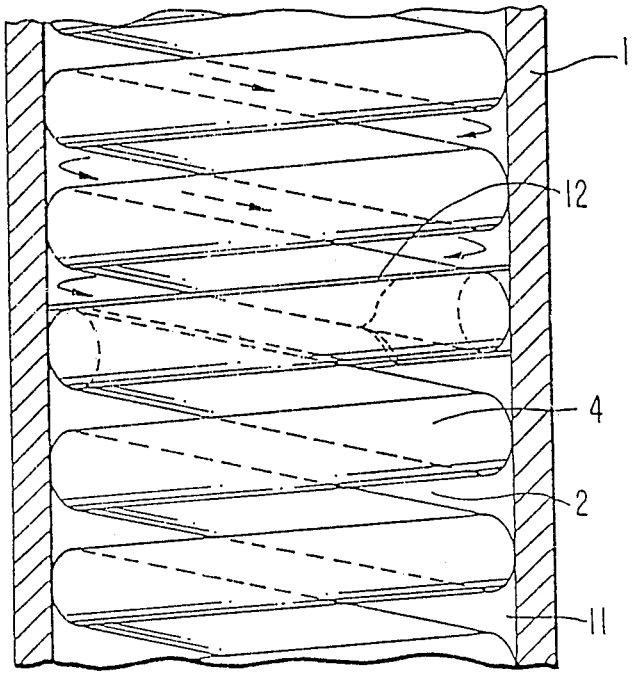
FIG. 1A is a partly sectional detailed view of the heat exchanger of FIG. 1, showing the fluid flow path in the interspace between adjacent coil turns along the periphery of the heat exchanger.

After the medium has left the slot 10 between the guide surface 9 and the casing 1 it will pass along the pipe coil 4 and primarily in the interspace 11 between the coil turns see arrows indicating flow path in FIG. 1A. Gradually, as the speed decreases, the influence of the centrifugal force will be reduced so that the medium will instead pass on through the space within the pipe coil, resulting in a considerably reduced heat exchange.

In order to avoid this and to maintain the rotary movement there is, according to the invention, arranged at least at one point between the two ends of the pipe coil 4 a body maintaining the circulation. In the embodiment according to FIG. 1 this body consists of a washer 12 having a diameter closely joining the inner diameter in the casing 1. The washer is provided with a slit recess 13 and is helically turned so that it can be introduced between the coil turns of the pipe coil 4.

As one or more bodies maintaining the circulation, e.g. the washer 12, have been placed at least at one point in the pipe coil 4 the gas still flowing on at a relatively high speed will again be forced into a helical path whereby it will again come into intimate contact with the pipe coil.

Figure 2:
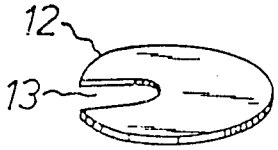
FIG. 2 shows, perspective, an embodiment of a body maintaining the circulation.
Figure 3:
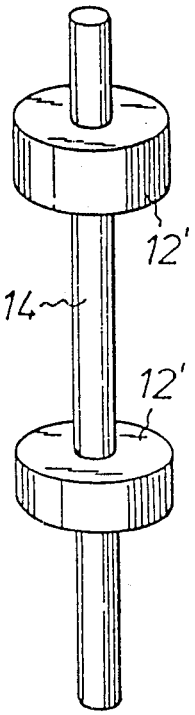
FIGS. 3 and 4 show two other embodiments of such a body.
Figure 4:
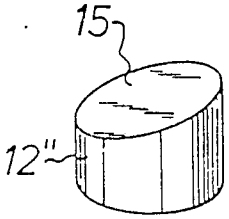

Instead of the washer 12 shown in FIGS. 1 and 2 it is possible, as is shown in FIG. 3, to utilize one or more plugs 12' passed on a rod 14 placed in the free space within the pipe coil. It is also possible to form the plug-like body so that it will fit in the pipe coil 4 and be retained by it. Such a plug may be provided with an inclined end surface 15, as shown on the body 12'' in FIG. 4''.

The washer 12, like the plugs 12' and 12'', ensures that the medium will be forced outwards towards the periphery of the space 2, whereby the medium tries to find its way through the interspace 11 between the pipe coil turns. This imparts a rotary movement to the medium.

It has been found that an efficiency increase of about 50% is obtained by the arrangement of bodies of the above-mentioned type in a heat exchanger of the embodiment herein concerned, as compared to a heat exchanger without such bodies.

Figure 5:
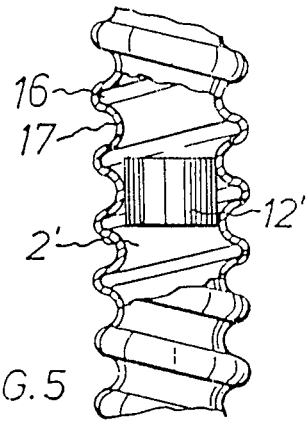
FIG. 5 shows a cross-section of part of another embodiment.

In the embodiment according to FIG. 5, the casing wall 1 itself, instead of the casing wall and the pipe coil 4, is of helical shape so as to constitute a helical trough 16 which axially is defined by equally helical ridges 17. The tangential inlet to the casing may be arranged similarly to that of the casing in FIG. 1. As seen radially beyond said wall 16–17 there is a space through which the other medium flows.

According to the invention there is also in this embodiment a body 12' or 12'' preventing axial flow through the space 2' and adapted to carry the gas in the space 2' outward towards the helical wall. The blocking body may have a diameter substantially corresponding to that of the space 2' as taken at ridges 17. As will be appreciated from the drawing, the flow preventing body presents a surface (an end surface of plug 12', for example) which lies approximately in a plane transversely intersecting the casing axis and which will substantially block fluid flow along the length of the casing inward from the helical flow path and thus force inwardly deviated fluid back into the helical path.

Figure 6:
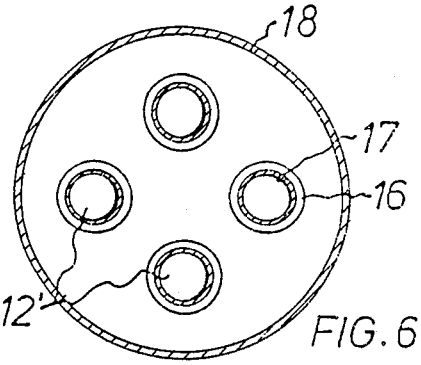
FIG. 6 shows schematically and in cross-section on a reduced scale an applied construction according to FIG. 5.

The embodiment according to FIG. 5 is particularly apt for composite heat exchangers where, as indicated in FIG. 6, several units may be mounted in a common vessel 18 and where the vessel constitutes a through-flow space for the liquid.

Figure 7:
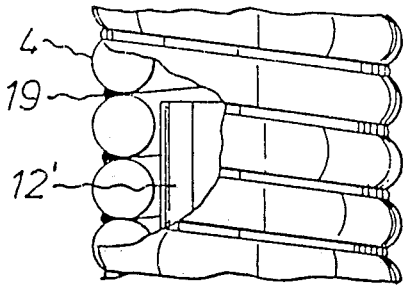
FIG. 7 shows, partly in section, part of still another embodiment of the heat exchanger.

In the further embodiment according to FIG. 7 the pipe coil 4 instead of the casing wall 1 is itself formed as a casing wall in that the tightly wound pipe turns are welded or soldered together, as is indicated by reference numeral 19. Also in this case there is inserted a preventing body 12' adapted to move the medium in the space 2' outwards towards the helical wall.

The invention should not be considered restricted to that described above and shown in the drawing but may be modified in various ways within the scope of the appended claims.

I claim:

1. Helical flow heat exchanger apparatus, comprising a hollow casing having a portion provided with an outwardly protruding peripheral helical trough extending lengthwise along the casing and defining a helical flow path along the internal periphery of the casing, inlet means disposed toward one end of the casing for introducing a fluid medium substantially tangentially into the casing such that the fluid medium will enter and initially follow said helical flow path, outlet means disposed toward another end of said casing for allowing the fluid medium to exit said casing, and blocking body means including at least one discrete blocking body disposed within said casing and occupying only an intermediate and relatively small part of the length of said portion of said casing having said helical trough and substantially filling the inner diameter of said casing inward from said helical trough for substantially blocking fluid flow along the length of said casing inward from said helical flow path and for forcing fluid medium which has deviated inwardly of said casing from said helical flow path outward and back into said flow path to maintain helical flow of the fluid medium

2. Apparatus according to claim 1, wherein said blocking body is shaped to guide the outward flow of fluid medium back into said helical flow path.

3. Apparatus according to claim 1, including means surrounding said casing for accommodating flow of an additional fluid medium externally against said casing to effect heat exchange between the fluid medium in said casing and said additional fluid medium.

4. Apparatus according to claim 1 wherein said blocking body has a surface situated approximately in a plane that transversely intersects the axis of said casing, said surface being of such shape and dimension as to substantially block fluid flow along the length of said casing and force inwardly deviated fluid medium outward and back into said flow path as aforesaid.

5. Apparatus according to claim 4, wherein said surface is inclined with respect to the axis of said casing.

6. Apparatus according to claim 4, wherein said plane is substantially perpendicular to the axis of said casing.

7. Apparatus according to claim 1, wherein said blocking body means includes a plurality of said discrete blocking bodies disposed within said casing at spaced locations along the length of said portion of said casing having said helical trough.

8. A composite heat exchanger comprising:

vessel means providing a fluid through-flow space, and a plurality of heat exchange devices, each of said heat exchange devices including a hollow casing surrounded by said vessel means and having a portion provided with an outwardly protruding peripheral helical trough which extends lengthwise along the casing and which defines a helical flow path along the internal periphery of the casing, inlet means disposed toward one end of the casing for introducing a fluid medium substantially tangentially into the casing such that the fluid medium will enter and initially follow said helical flow path, outlet means disposed toward another end of said casing for allowing the fluid medium to exit said casing, and blocking body means including at least one discrete blocking body disposed within said casing and occupying only an intermediate and relatively small part of the length of said portion of said casing having said helical trough and substantially filling the inner diameter of said casing inward from said helical trough for substantially blocking fluid flow along the length of said casing inward from said helical flow path and forcing fluid medium which has deviated inwardly of said casing from said helical flow path outward and back into said flow path to maintain helical flow of the fluid medium.

* * * * *